US005745944A

United States Patent [19]

Hall

[11] Patent Number: 5,745,944

[45] Date of Patent: May 5, 1998

[54] DOOR MOUNTED SHOE TREE AND LAST

[76] Inventor: Milo Hall, 6912 Cumberland Cir., Riverdale, Ga. 30296

[21] Appl. No.: 807,570

[22] Filed: Feb. 27, 1997

[51] Int. Cl.[6] ..... A43D 3/14; A43D 5/00; A47L 23/18

[52] U.S. Cl. ..... 12/117.4; 12/123; 12/124; 15/265; 15/267

[58] Field of Search ..... 12/117.4, 123, 12/124, 125, 116.2, 116.6; 15/265, 267

[56] References Cited

U.S. PATENT DOCUMENTS 1,686,133 10/1928 Hill ..... 12/123
1,859,536 5/1932 Schulse ..... 12/117.4 X
2,459,310 1/1949 Crow ..... 12/123
2,575,408 11/1951 Chester ..... 12/117.4 X
2,967,312 1/1961 Drew ..... 12/125

*Primary Examiner*—Ted Kavanaugh

[57] ABSTRACT

The present invention provides an unique and compact shoe support apparatus for supporting and holding a shoe at an operable position. This mounting means frees both hands of the user for cleaning and polishing. The apparatus includes a 'U' shaped mounting bracket which fastens to both door knobs. The mounting bracket is adapted to receive a shoe tree device which is adjustable to accommodate various sizes of shoes. The shoetree has an adjustable heel snubber portion which functions to hold the shoe in place through a combination of a rearward force and a grip developed between the inside heel portion of the shoe and the last located in the toe portion of the shoe.

2 Claims, 4 Drawing Sheets

DOOR MOUNTED SHOE TREE AND LAST

BACKGROUND OF THE INVENTION

1. Field of the Invention

The present invention relates to shoe shining devices. More particularly, the present invention relates to shoe holding devices for polishing shoes.

2. Description of the Prior Art

For the well dressed man or woman, cleaned and polished shoes are a required and necessary part of a wardrobe. For the person who maintains his own shoes it is desirable to have a device to hold the shoes securely while polishing and cleaning. The prior art discloses inventions which are overly complex for the function they provide. Further the prior devices require permanent mounting means and cosmetically damage the mounting surfaces. What is desired is a simple device that is removably, convenient and easily mounted at an operable height.

Numerous innovations for Door Mounted Shoe Tree and Last have been provided in the prior art that are described as follows. Even though these innovations may be suitable for the specific individual purposes to which they address, they differ from the present invention as hereinafter contrasted.

In U.S. Pat. No. 4,109,335, titled "Shoe Support Apparatus", invented by Robert C. Randolph, shows a shoe support apparatus, particularly for supporting a shoe thereon during the performance of a shoe shining operation, is disclosed. A base panel is adapted to be secured to a vertical support surface, such as, for example, a wall or a door. A shoe support member is pivotably mounted adjacent the lower portion of the panel. A shoe retaining assembly is pivotally mounted adjacent the upper portion of the panel and comprises three relatively movable sections including a shoe tree structure. The sections are connected by unique pivot joints formed of integral parts of said sections, and are so arranged as to define an over-center type locking mechanism. In this manner, the apparatus is able to be collapsed for storage and quickly erected and locked for rigidly supporting the shoe during a shoe polishing operation.

The patented invention differs from the present invention because the patented invention is fastened to a mounting plate which is in turn fastened to a mounting surface. The mounting is permanent and requires fastening holes to be made in the fastening surface. The present invention is a shoe tree adapted to fasten to a bracket the bracket has a removable means attaching it to a door by means of a door knob. The present invention does not require modification of the door and it does not damage the door surface in any way during the mounting and dismounting process. When in an operable position the present invention provides a secure and removable means of supporting a shoe for cleaning and polishing.

In U.S. Pat. No. 4,483,039, titled "Shoe Support Apparatus", invented by Cydney E. Breen, a shoe support apparatus, particularly for supporting a shoe for cleaning and shining, in the form of a base plate that is designed for temporary mounting to a conventional door and that has an outwardly extending shoe support means which comprises a heel support and a spring-loaded adjustable toe support that is connected thereto in a manner permitting a slight amount of rocking motion of the toe support. For door mounting, the base plate has a tapered opening so that it can be received over a doorknob and hung from the doorknob stem, and further has clamping means for clamping the base plate securely to the door edge adjacent the doorknob. The apparatus may be partially collapsed and totally removed from the door for portability and storage.

The patented invention differs from the present invention because the patented invention is a bracket fastened to a first face of a door at a door knob via a bracket having a keyhole opening which surrounds the door knob. A clamp grasps the opposite face of the door functioning to pull the bracket against the first face to securely fasten the patented invention to the door. The present invention is a shoe tree adapted to fasten to a 'U' shaped bracket. The 'U' shaped bracket has two sides with a door knob attachment means on one end of each side. A front member joins the two sides. At a lower portion of the front member an adjustment screw is attached which functions to apply pressure against an upper end of the front member. The upper end of the front acts as a fulcrum to push the door knob attachment means hooks against the door knob. The present invention does not require modification of the door and it does not damage the door surface in any way during the mounting and dismounting process. When in an operable position the present invention provides a secure and removable means of supporting a shoe for cleaning and polishing.

In U.S. Pat. No. 5,136,746, titled "Adjustable Shoe Holder and Support", invented by Williard Jones, an universal shoe holder having a detachable mounting member for securing the holder to a work surface, and a supporting member which supports the shoe holding mechanism perpendicular to the mounting member. The shoe holding mechanism consists of a holding member fastened to the support member, and a heel support member which is pivotally attached thereto. A tightening mechanism is provided which exerts pressure on the heel support member and the holding member, allowing the shoe holder to securely hold various styles and sizes of shoes during repair and polishing procedures. An adjusting mechanism is included to allow the shoe holder to be adjusted to fit different sizes of shoes.

The patented invention differs from the present invention because the patented invention is removably fastened to a mounting plate which is in turn fastened to a mounting surface. The mounting is permanent and requires fastening holes to be made in the fastening surface. The present invention is a shoe tree adapted to fasten to a bracket . the bracket has a removable means attaching it to a door by means of a door knob. The present invention does not require modification of the door and it does not damage the door surface in any way during the mounting and dismounting process. When in an operable position the present invention provides a secure and removable means of supporting a shoe for cleaning and polishing.

In U.S. Pat. No. 5,046,210, titled "Wall Mountable Shoe Shining Apparatus", invented by Charles N. Garrett, Sr., an apparatus for use in shoe shining is provided having a frame, a lower support pivotally mounted on the frame for receiving a shoe, the lower support being pivot able upwardly from a position parallel and adjacent to the frame to a horizontal position substantially perpendicular to the frame, a shoe retaining arm pivotally mounted on the frame above the lower support for engaging the inner sole of the shoe at the heel area, the shoe retaining arm being pivotable downwardly to a substantially horizontal position above the horizontal position of the lower support, the shoe retaining arm including a holding element for contacting the inner sole of the shoe at the heel area and the holding element being vertically adjustable to provide a clamping force for securing the shoe onto the lower support.

The patented invention differs from the present invention because the patented invention is permanently fastened to a wall. The patented invention includes storage means for shoe shine supplies. The mounting is permanent and requires fastening holes to be made in the fastening surface. The patented invention securely fastens a shoe by device which applies downward pressure to the sole of a shoe forcing the shoe against a horizontal surface. The present invention is a shoe tree adapted to fasten to a bracket. A heel portion of the shoe tree is adjustable functioning to grasp the heel portion of a shoe and apply rearward pressure forcing the toe of the shoe against the last of the shoe tree. The bracket has a removable means attaching it to a door by means of a door knob. The present invention does not require modification of the door and it does not damage the door surface in any way during the mounting and dismounting process. When in an operable position the present invention provides a secure and removable means of supporting a shoe for cleaning and polishing.

Numerous innovations for Door Mounted Shoe Tree and Last have been provided in the prior art that are adapted to be used. Even though these innovations may be suitable for the specific individual purposes to which they address, they would not be suitable for the purposes of the present invention as heretofore described.

SUMMARY OF THE INVENTION

The present invention provides an unique and compact shoe support apparatus for supporting and holding a shoe at an operable position. This mounting means frees both hands of the user for cleaning and polishing. The apparatus includes a 'U' shaped mounting bracket which fastens to both door knobs. The mounting bracket is adapted to receive a shoe tree device which is adjustable to accommodate various sizes of shoes. The shoetree has an adjustable heel snubber portion which functions to hold the shoe in place through a combination of a rearward force and a grip developed between the inside heel portion of the shoe and the last located in the toe portion of the shoe.

More specifically the adjustable heel snubber comprises a thumb screw and a rectangular nut which rides in an elongated track in a shoe tree arm. The user positions a shoe over the last and the adjustable heel snubber in contact with the rear inside portion of the heel. The adjustable heel snubber shoe tree arm is slide backward to be in contact with the inside heel. Further movement forces the heel rearward which brings the last into contact with a toe area of the shoe. The resulting pressure secures the shoe in place on the shoetree.

The types of problems encountered in the prior art are that the fastening means requires a permanent member to be installed against a mounting surface.

In the prior art, unsuccessful attempts to solve this problem were attempted namely complex devices which require permanent mounting. However, the problem was solved by the present invention because the present invention is fastened to a door knob and is easily removable with out modification to the existing door.

The present invention solved a long felt need for simple way of supporting a shoe while it is being polished.

Accordingly, it is an object of the present invention to provide an attachment means to a door, specifically the door knob.

More particularly, it is an object of the present invention to provide a device that is removably attached to a door knob.

In keeping with these objects, and with others which will become apparent hereinafter, one feature of the present invention resides, briefly stated, in shoe tree attached to a door by a bracket, having an adjustment means which grips a shoe by forcing it against a the last with a heel adjustment device.

When the shoe tree is designed in accordance with the present invention, a secure adjustable means of attachment of a shoe is achieved.

In accordance with another feature of the present invention, the bracket is adaptable to any door and is securely fastened to the door by operation of a thumb screw.

Another feature of the present invention is that the shoe tree arm can be installed on to a shoe remote from the door then attached to the bracket.

Yet another feature of the present invention is that the shoe tree arm comprises a means of adjustment of a heel snubber to force the front of a shoe against the last of the shoe tree.

Still another feature of the present invention is that a heel snubber clamp clamps to the shoe tree arm.

Yet still another feature of the present invention is that shoe tree comprises a last which fits into the toe of a shoe to support the front of the shoe.

The novel features which are considered characteristic for the invention are set forth in the appended claims. The invention itself however, both as to its construction and its method of operation, together with additional objects and advantages thereof, will be best understood from the following description of the specific embodiments when read and understood in connection with the accompanying drawing(s).

BRIEF LIST OF REFERENCE NUMERALS UTILIZED IN THE DRAWING

10—door mounted shoe tree and last (10)
12—bracket (12)
12A—bracket hook (12A)
12B—bracket notch (12B)
12C—bracket track (12C)
12CA—bracket track right wall (12CA)
12CB—bracket track right front (12CB)
12CC—bracket track left wall (12CC)
12CD—bracket track left front (12CD)
12CE—bracket track lower stop (12CE)
12D—bracket bearing point (12D)
14—shoe tree (14)
14A—shoe tree arm (14A)
14AA—shoe tree arm slot (14AA)
14B—shoe tree last (14B)
14BA—shoe tree last pivot pin (14BA)
14C—shoe tree arm tee (14C)
14D—shoe tree arm insertion/removal direction (14D)
16—adjustable heel snubber (16)
16A—adjustable heel snubber clamp (16A)
16AA—adjustable heel snubber clamp back upper face (16AA)
16AB—adjustable heel snubber clamp top (16AB)
16AC—adjustable heel snubber clamp front (16AC)
16AD—adjustable heel snubber clamp bottom (16AD)
16AE—adjustable heel snubber clamp back lower face (16AE)
16B—adjustable heel snubber thumb screw (16B)

16BA—adjustable heel snubber knob (16BA)

16BB—adjustable heel snubber shaft (16BB)

16C adjustable heel snubber square nut (16C)

16D—adjustable heel snubber adjustment direction (16D)

18—thrust screw (18)

18A—thrust screw handle (18A)

18B—threaded shaft (18B)

20—shoe (20)

22—door knob (22)

24—door (24)

BRIEF DESCRIPTION OF THE PREFERRED EMBODIMENT

DETAILED DESCRIPTION OF THE PREFERRED EMBODIMENT

Figure 1:
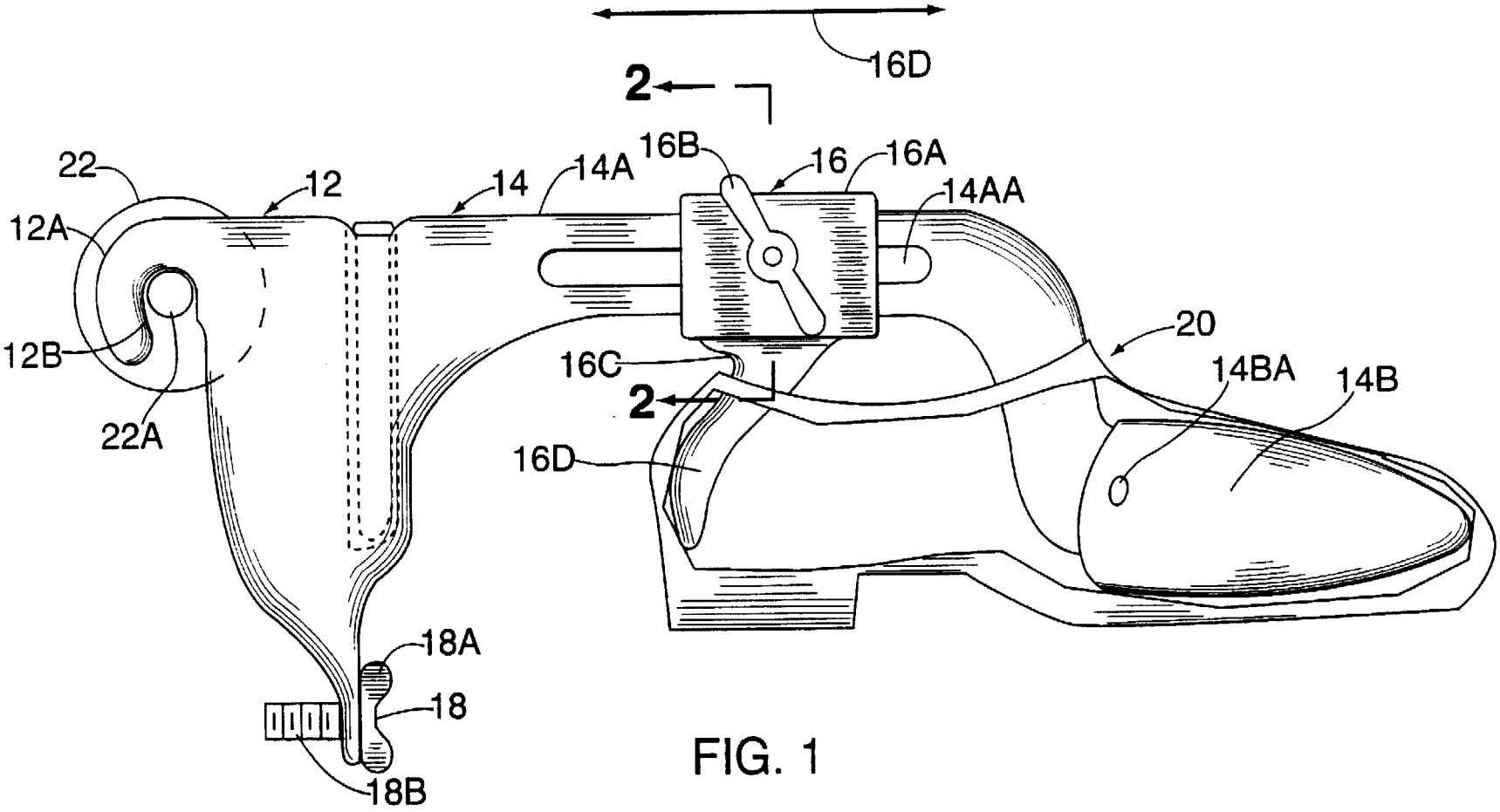
FIG. 1 is a side view of a door mounted shoe tree and last.

Firstly, referring to FIG. 1 which is a side view of a door mounted shoe tree and last (10) comprising a bracket (12), which is removably fastened to a door (24) at a door knob (22). The bracket (12) comprises a bracket hook (12A) formed about a bracket notch (12B). The bracket hook (12A) is hooked around a door knob (22). The bracket (12), having a front face together with left and a right side each having a front edge which are securely attached to opposite edges of the bracket (12) front face forming an opening therebetween. The opening therebetween having a bracket bearing point (12D) at an upper point.

The bracket (12) further comprises a bracket track (12C), a proximal edge of a bracket track right wall (12CA) is securely attached orthogonal to a right side of the bracket track (12C) front face, an opposite edge of the bracket track right wall (12CA) is securely attached to at right angles to a bracket track right front (12CB).

The bracket (12) is further securely attached along a left edge of the bracket (12) front face to proximal edge of a bracket track left wall (12CC). The opposite edge of the bracket track left wall (12CC) is securely attached a proximal edge of a bracket track left front (12CD). A bracket track lower stop (12CE) is securely attached along a left edge to a lower edge of the bracket track right wall (12CA). The bracket track lower stop (12CE) is securely attached along a rear edge to a bracket track (12C) front face. The bracket track lower stop (12CE) is securely attached along a right edge to a lower edge of a bracket track right front (12CB). The bracket track right front (12CB), bracket track left front (12CD), bracket track lower stop (12CE), bracket track (12C) front face, bracket track left wall (12CC), and bracket track right wall (12CA) together form a 'T' shaped receptacle opening with a bottom stop.

A shoe tree (14) comprises a shoe tree arm (14A) having an elongated shoe tree arm slot (14AA) therein. An outer end of the shoe tree arm (14A) is securely attached to a shoe tree last (14B) by a shoe tree last pivot pin (14BA). The shoe tree last (14B) functions to grip a shoe having a toe portion therein. An inner end of the shoe tree arm (14A) is securely attached to a shoe tree arm tee (14C). The shoe tree arm tee (14C) functions in cooperation with the 'T' shaped receptacle opening in the bracket track (12C) when inserted along a shoe tree arm insertion/removal direction (14D) to securely and removably attache the shoe tree (14) to the bracket (12).

An adjustable heel snubber (16) is adjustably attached to the shoe tree (14). The adjustable heel snubber (16) comprises an adjustable heel snubber clamp (16A) which is slidably attached to the shoe tree arm (14A). The adjustable heel snubber clamp (16A) comprises an adjustable heel snubber clamp back upper face (16AA) having an upper and lower edge. The upper edge of the adjustable heel snubber clamp back upper face (16AA) is securely attached to a right edge of adjustable heel snubber clamp top (16AB). A left edge of the adjustable heel snubber clamp top (16AB) is securely attached to an upper edge of an adjustable heel snubber clamp front (16AC). A lower edge of the adjustable heel snubber clamp front (16AC) is securely attached to a left edge of an adjustable heel snubber clamp bottom (16AD). A right edge of the adjustable heel snubber clamp bottom (16AD) is securely attached to a lower edge of an adjustable heel snubber clamp back lower face (16AE). The upper edge of the adjustable heel snubber clamp back lower face (16AE) and the lower edge of the adjustable heel snubber clamp back upper face (16AA) form an opening therebetween. An adjustable heel snubber thumb screw (16B) comprises an adjustable heel snubber knob (16BA) which is securely attached to an adjustable heel snubber shaft (16BB). The adjustable heel snubber shaft (16BB) threadably attached to an adjustable heel snubber square nut (16C) which sidably operates within the shoe tree arm slot (14AA). The adjustable heel snubber (16) when moved in an adjustable heel snubber adjustment direction (16D) functions to grip the inside rear upper of a shoe (20) forcing the shoe tree last (14B) into the toe of the shoe (20) securely fastening the shoe (20) to the door mounted shoe tree and last (10).

A thrust screw (18) comprises a thrust screw handle (18A) which is securely attached to a threaded shaft (18B). The threaded shaft (18B) is threadably attached to a lower front portion of the bracket (12). The thrust screw (18) when operably rotated causes the bracket (12) to rotate about the door knob (22) forcing the bracket bearing point (12D) against the door (24) front edge which rigidly secures the bracket (12) to the door (24).

The door mounted shoe tree and last (10) is manufactured from materials selected from a group consisting of metal, metal alloy, plastic, plastic composite, fiberglass, epoxy, carbon-graphite, and wood.

Figure 2:
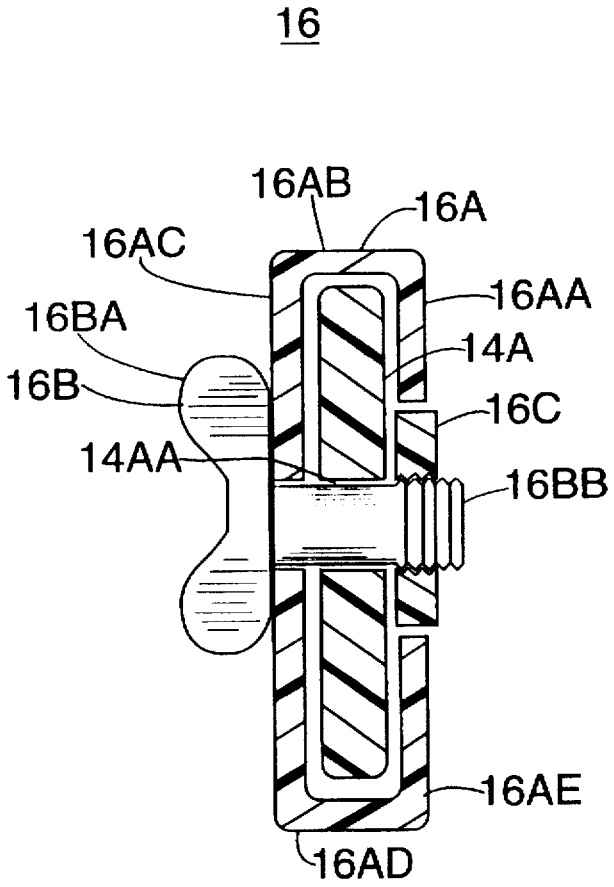
FIG. 2 is a cutaway view of an adjustable heel snubber

Secondly, referring to FIG. 2 which is a cutaway view of an adjustable heel snubber clamp (16A). The adjustable heel snubber clamp (16A) encompass the shoe tree arm (14A) and is slidably attached thereto. The adjustable heel snubber clamp (16A) comprises an adjustable heel snubber clamp back upper face (16AA) having an upper and lower edge. The upper edge of the adjustable heel snubber clamp back upper face (16AA) is securely attached to a right edge of adjustable heel snubber clamp top (16AB). A left edge of the adjustable heel snubber clamp top (16AB) is securely attached to an upper edge of an adjustable heel snubber clamp front (16AC). A lower edge of the adjustable heel snubber clamp front (16AC) is securely attached to a left edge of an adjustable heel snubber clamp bottom (16AD). A right edge of the adjustable heel snubber clamp bottom (16AD) is securely attached to a lower edge of an adjustable heel snubber clamp back lower face (16AE). The upper edge of the adjustable heel snubber clamp back lower face (16AE) and the lower edge of the adjustable heel snubber clamp back upper face (16AA) form an opening therebetween, an adjustable heel snubber thumb screw (16B) comprises an adjustable heel snubber knob (16BA) which is securely attached to an adjustable heel snubber shaft (16BB).

The adjustable heel snubber shaft (16BB) threadably attached to an adjustable heel snubber square nut (16C) which slidably operates within the shoe tree arm slot (14AA). The adjustable heel snubber (16) when moved in an adjustable heel snubber adjustment direction (16D) functions to grip the inside rear upper of a shoe (20).

Figure 3:
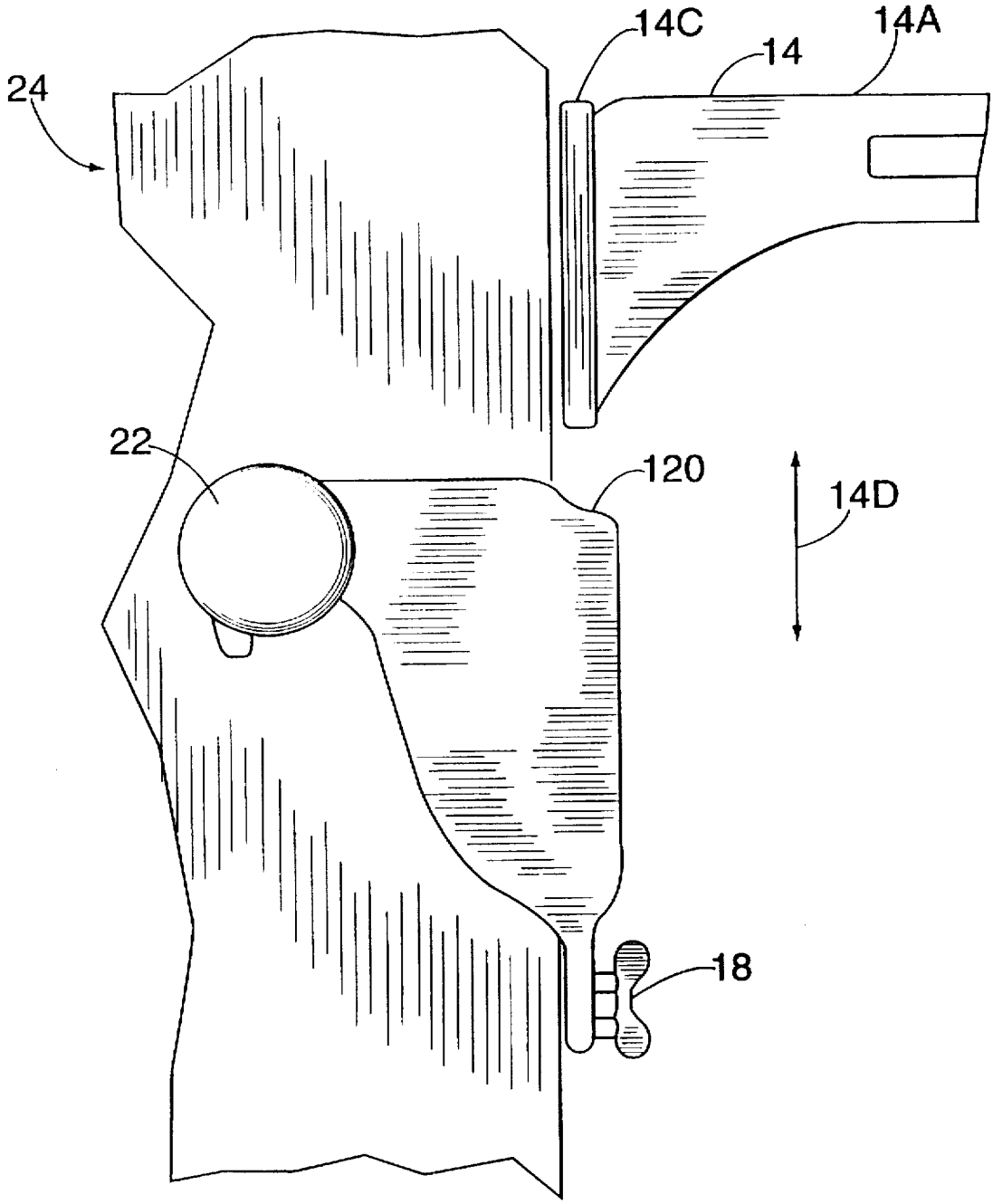
FIG. 3 is a close up view of a bracket and a shoe tree.

Thirdly, referring to FIG. 3 which is a close up view of a bracket (12), which is removably fastened to a door (24) at a door knob (22). The bracket (12) comprises a bracket hook (12A) formed about a bracket notch (12B), the bracket hook (12A) is hooked around a door knob (22)

The bracket (12) has a front face together with left and a right side each having a front edge which are securely attached to opposite edges of the bracket (12) front face forming a form a 'T' shaped receptacle opening with a bottom stop therebetween. The bracket (12) front face has a bracket bearing point (12D) at an upper point.

A shoe tree (14) comprises a shoe tree arm (14A). The inner end of the shoe tree arm (14A) is securely attached to a shoe tree arm tee (14C). The shoe tree arm tee (14C) functions in cooperation with the 'T' shaped receptacle opening in the bracket track (12C) so that when the shoe tree arm tee (14C) is inserted along a shoe tree arm insertion/removal direction (14D) the shoe tree (14) and the bracket (12) are securely and removably attached together.

A thrust screw (18) is threadably attached to a lower front portion of the bracket (12). The thrust screw (18) when operably rotated causes the bracket (12) to rotate about the door knob (22) forcing the bracket bearing point (12D) against the door (24) front edge which rigidly secures the bracket (12) to the door (24).

Figure 4:
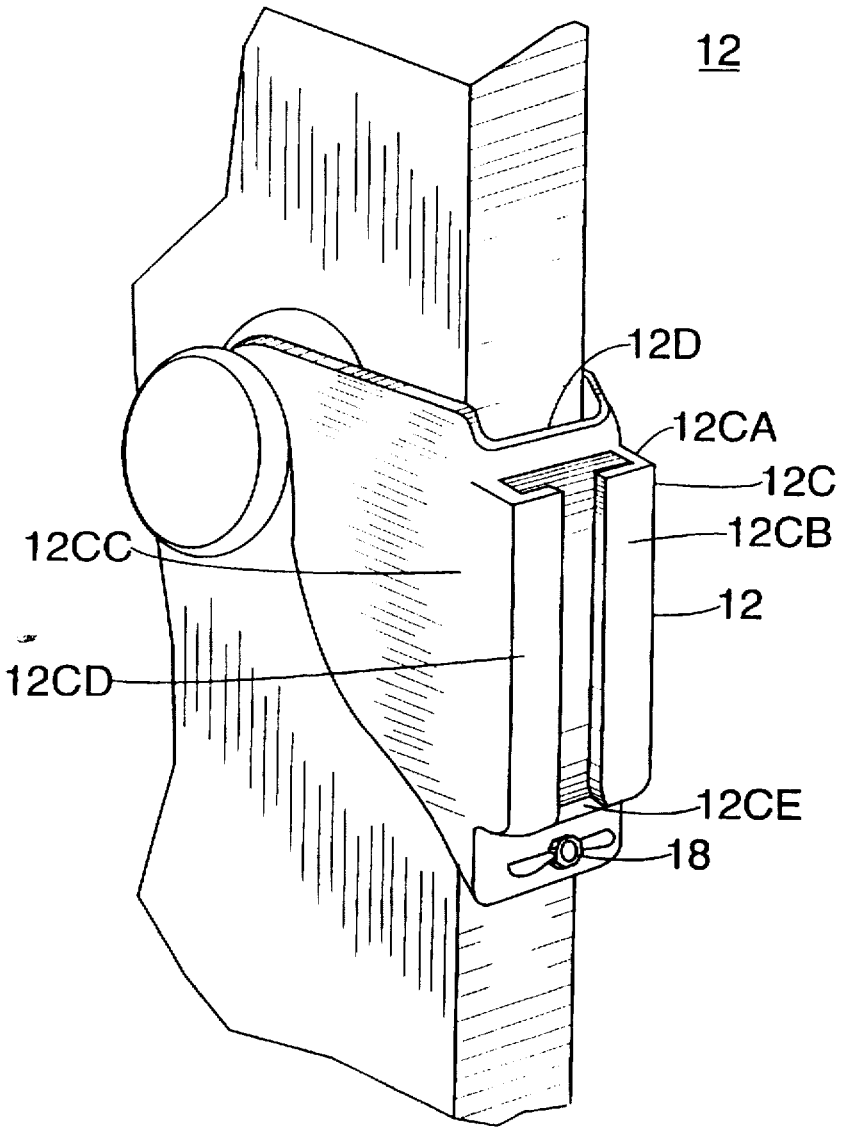
FIG. 4 is a close up perspective view of a bracket.

Lastly, referring to FIG. 4 which is a close up perspective view of a bracket (12). The bracket (12) is removably fastened to a door (24) at a door knob (22). The bracket (12) comprises a bracket hook (12A) formed about a bracket notch (12B) which is hooked around a door knob (22). The bracket (12) has a front face together with left and a right side each having a front edge which are securely attached to opposite edges of the bracket (12) front face forming an opening therebetween. The opening therebetween having a bracket bearing point (12D) at an upper point.

The bracket (12) further comprises a bracket track (12C) which comprises a bracket track right wall (12CA). A proximal edge of a bracket track right wall (12CA) is securely attached orthogonally to a right side of the bracket (12) front face. An opposite edge of the bracket track right wall (12CA) is securely attached to at right angles to a bracket track right front (12CB).

The bracket track (12C) comprises a bracket track left wall (12CC) which is securely attached along a left edge to a left edge of the bracket (12) front face. The opposite edge of the bracket track left wall (12CC) is securely attached a proximal edge of a bracket track left front (12CD). A bracket track lower stop (12CE) is securely attached along a left edge to a lower edge of the bracket track right wall (12CA). The bracket track lower stop (12CE) is securely attached along a rear edge to a bracket track (12C) front face. The bracket track lower stop (12CE) is securely attached along a right edge to a lower edge of a bracket track right front (12CB). The bracket track right front (12CB), bracket track left front (12CD), bracket track lower stop (12CE), bracket track (12C) front face, bracket track left wall (12CC) and bracket track right wall (12CA) together form a 'T' shaped receptacle opening with a bottom stop.

A thrust screw (18) comprises is threadably attached a lower front portion of the bracket (12). The thrust screw (18) when operably rotated causes the bracket (12) to rotate about the door knob (22) forcing the bracket bearing point (12D) against the door (24) front edge which rigidly secures the bracket (12) to the door (24).

It will be understood that each of the elements described above, or two or more together, may also find an useful application in other types of constructions differing from the type described above.

While the invention has been illustrated and described as embodied in a Door Mounted Shoe Tree and Last, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is desired to be protected by Letters Patent is set forth in the appended claims.

What is claimed is:

1. A door mounted shoe tree and last (10), functioning to support a standard shoe at an operable position for polishing, the door mounted shoe tree and last (10) comprising:

A) a bracket (12) which is removably attached to an opening edge of a door, the bracket (12) comprises a left side which is securely attached at a front edge to a left edge of a bracket (12) front face, a right edge of the bracket (12) front face is securely attached to a front edge of a right side of the bracket (12), the bracket (12) left side and the bracket (12) right side are substantially the same, the bracket (12) left side and the bracket (12) right side and the bracket (12) front face form an opening therebetween, a door edge is inserted into the opening therebetween, an upper point of the bracket (12) front face comprises a bracket bearing point (12D) which functions as a fulcrum, the bracket (12) further comprises a bracket track (12C) attached to the front face of the bracket (12), the bracket (12) is removably fastenable to a door knob (22) of a door (24), the bracket (12) comprises a bracket hook (12A) formed about a bracket notch (12B), the bracket hook (12A) is hooked around the door knob (22), a proximal edge of a bracket track right wall (12CA) is securely attached orthogonal to a right side of the bracket track (12C) front face, an opposite edge of the bracket track right wall (12CA) is securely attached at right angles to a bracket track right front (12CB), the bracket (12) is further securely attached along a left edge of the bracket (12) front face to a proximal edge of a bracket track left wall (12CC), the opposite edge of the bracket track left wall (12CC) is securely attached to a proximal edge of a bracket track left front (12CD), a bracket track lower stop (12CE) is securely attached along a left edge to a lower edge of the bracket track right wall (12CA), the bracket track lower stop (12CE) is securely attached along a rear edge to a bracket track (12C) front face, the bracket track lower stop (12CE) is securely attached along a right edge to a lower edge of a bracket track right front (12CB), the bracket track right front (12CB) and bracket track left front (12CD) and bracket track lower stop (12CE) and bracket track (12C) front face and bracket track left wall (12CC) and bracket track right wall (12CA) together form a 'T' shaped receptacle opening with a bottom stop positioned at a lower end of the bracket track (12C);

B) a shoe tree (14) comprises a shoe tree arm (14A) having an elongated shoe tree arm slot (14AA) therein, an outer end of the shoe tree arm (14A) is securely attached to a shoe tree last (14B) by a shoe tree last pivot pin (14BA), the shoe tree last (14B) functions to grip a shoe having a toe portion therein, an inner end of the shoe tree arm (14A) is securely attached to a shoe tree arm tee (14C), the shoe tree arm tee (14C) functions in cooperation with the 'T' shaped receptacle opening in the bracket track (12C) when inserted along a shoe tree arm insertion/removal direction (14D) to securely and removably attach the shoe tree (14) to the bracket (12);

C) an adjustable heel snubber (16) is adjustably attached to the shoe tree (14), the adjustable heel snubber (16) comprises an adjustable heel snubber clamp (16A) which is slidably attached to the shoe tree arm (14A), the adjustable heel snubber clamp (16A) comprises an adjustable heel snubber clamp back upper face (16AA) having an upper and lower edge, the upper edge of the adjustable heel snubber clamp back upper face (16AA) is securely attached to a right edge of adjustable heel snubber clamp top (16AB), a left edge of the adjustable heel snubber clamp top (16AB) is securely attached to an upper edge of an adjustable heel snubber clamp front (16AC), a lower edge of the adjustable heel snubber clamp front (16AC) is securely attached to a left edge of an adjustable heel snubber clamp bottom (16AD), a right edge of the adjustable heel snubber clamp bottom (16AD) is securely attached to a lower edge of an adjustable heel snubber clamp back lower face (16AE), the upper edge of the adjustable heel snubber clamp back lower face (16AE) and the lower edge of the adjustable heel snubber clamp back upper face (16AA) form an opening therebetween, an adjustable heel snubber thumb screw (16B) comprises an adjustable heel snubber knob (16BA) which is securely attached to an adjustable heel snubber shaft (16BB), the adjustable heel snubber shaft (16BB) threadably attaches to an adjustable heel snubber square nut (16C) which slidably operates within the shoe tree arm slot (14AA), when the adjustable heel snubber (16) is moved in an adjustable heel snubber adjustment direction (16D) functions to grip the inside rear upper of a shoe (20) forcing the shoe tree last (14B) into the toe of the shoe (20) securely fastening the shoe (20) to the door mounted shoe tree and last (10); and D) a thrust screw (18) which comprises a thrust screw handle (18A) securely attached to a threaded shaft (18B), the threaded shaft (18B) is threadably attached to a lower front portion of the bracket (12), when the thrust screw (18) is operably rotated, causes the bracket (12) to rotate about the door knob (22) forcing the bracket bearing point (12D) against the door (24) front edge which rigidly secures the bracket (12) to the door (24).

2. The door mounted shoe tree and last (10) as described in claim 1, wherein the door mounted shoe tree and last (10) is manufactured from a material selected from a group consisting of metal, metal alloy, plastic, plastic composite, fiberglass, epoxy, carbon-graphite and wood.

* * * * *